US006648612B2

(12) United States Patent
Hsiao

(10) Patent No.: US 6,648,612 B2
(45) Date of Patent: Nov. 18, 2003

(54) OIL-FREE AIR COMPRESSOR

(76) Inventor: I-Min Hsiao, No. 427, Sec. 2, Doou-Chung Rd., Tien-Chung, Chang-Hwa (TW)

( * ) Notice: Subject to any disclaimer, the term of this patent is extended or adjusted under 35 U.S.C. 154(b) by 0 days.

(21) Appl. No.: 10/103,967

(22) Filed: Mar. 25, 2002

(65) Prior Publication Data

US 2003/0180161 A1 Sep. 25, 2003

(51) Int. Cl.[7] ..... F04B 23/00; F04B 39/10

(52) U.S. Cl. ..... 417/313; 417/321; 417/415; 417/545

(58) Field of Search ..... 417/313, 321, 417/410.1, 415, 545

(56) References Cited

U.S. PATENT DOCUMENTS 4,028,015 A * 6/1977 Hetzel ..... 417/415
5,600,953 A * 2/1997 Oshita et al. ..... 60/453
6,213,725 B1 * 4/2001 Chou ..... 417/63
6,485,266 B2 * 11/2002 DeRuyter ..... 417/201
6,530,760 B1 * 3/2003 Graber et al. ..... 417/545

* cited by examiner

*Primary Examiner*—Cheryl J. Tyler
*Assistant Examiner*—Michael K. Gray
(74) *Attorney, Agent, or Firm*—Dennison, Schultz & Doughtery

(57) ABSTRACT

An oil-free air compressor is characterized in an air inlet provided at a lateral open end of a crankcase of the air compressor. External air enters into the crankcase via the lateral air inlet and then enters into a cylinder above the crankcase via a check valve provided on a piston head in the cylinder. Air in the cylinder is compressed by the piston head and then discharged to an air storage tank via a single air outlet provided on a cylinder head of the cylinder.

2 Claims, 6 Drawing Sheets

OIL-FREE AIR COMPRESSOR

BACKGROUND OF THE INVENTION

FIG. 1 shows main structure and operating manner of a conventional air compressor. Power produced by a motor 16 is transferred to a piston rod 12 via an idle wheel 22, so that the piston rod 12 moves in a crankcase 14 in circular motion and a piston head 24 of the piston rod 12 moves in a cylinder 18 in reciprocating motion. The cylinder 18 has a cylinder head 10 provided with a top cover 30. The top cover 30 is formed of an air inlet 26 and an air outlet 28, both of which have a check valve mounted thereat. When the piston head 24 moves downward, external air is guided into the cylinder 18 via the air inlet 26 and the check valve (not shown) mounted thereat. The check valve functions to prevent air from flowing back to external environment via the air inlet 26. When the piston head 24 moves upward, it compresses the air guided into the cylinder 18. The compressed air flows through another check valve 20 mounted at the air outlet 28 and passes the air outlet 28 into an air storage tank connected to the air compressor. The check valve 20 functions to prevent air from flowing back from the air storage tank into the cylinder 18.

Since the conventional air compressor has air inlet and air outlet that all are provided on the cylinder head, the cylinder and the cylinder head are subject to temperature rise when they have been moving over an extended period of time. The heated cylinder and cylinder head results in relative increase of temperature of the air guided into the cylinder and accordingly lowered compression efficiency. Moreover, the temperature rise also causes thermal expansion of the cylinder to increase noises and errors during operation thereof, and decrease the usable life of the cylinder.

SUMMARY OF THE INVENTION

It is therefore a primary object of the present invention to solve the above-mentioned problems by providing an improved oil-free air compressor, in which only the air outlet is provided on the cylinder head. The air compressor of the present invention has an air inlet that is provided on a lateral end of the crankcase, so that external air is guided into the air compressor via the lateral air inlet to pass through a check valve on the piston head and into the cylinder, at where the air is compressed with the piston. The compressed air is then discharged from the cylinder to the air storage cylinder via the only one air outlet provided on the cylinder head. With these arrangements, air guided into the cylinder is always external cold air that effectively reduces the temperature of the cylinder and the cylinder head to increase the compression efficiency and the usable life of the cylinder.

Another object of the present invention is to provide an improved oil-free air compressor that has an air inlet provided at a lateral open end of the crankcase thereof, enabling the air inlet to have increased dimensions large enough for a filter to removably mount therein to screen off impurities in the external air entering into the cylinder via the air inlet.

A further object of the present invention is to provide an improved oil-free air compressor that has a cylinder head on which only an air outlet is provided, enabling the cylinder head and the piston to have reduced dimensions and therefore be more easily manufactured, assembled, maintained, and repaired.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
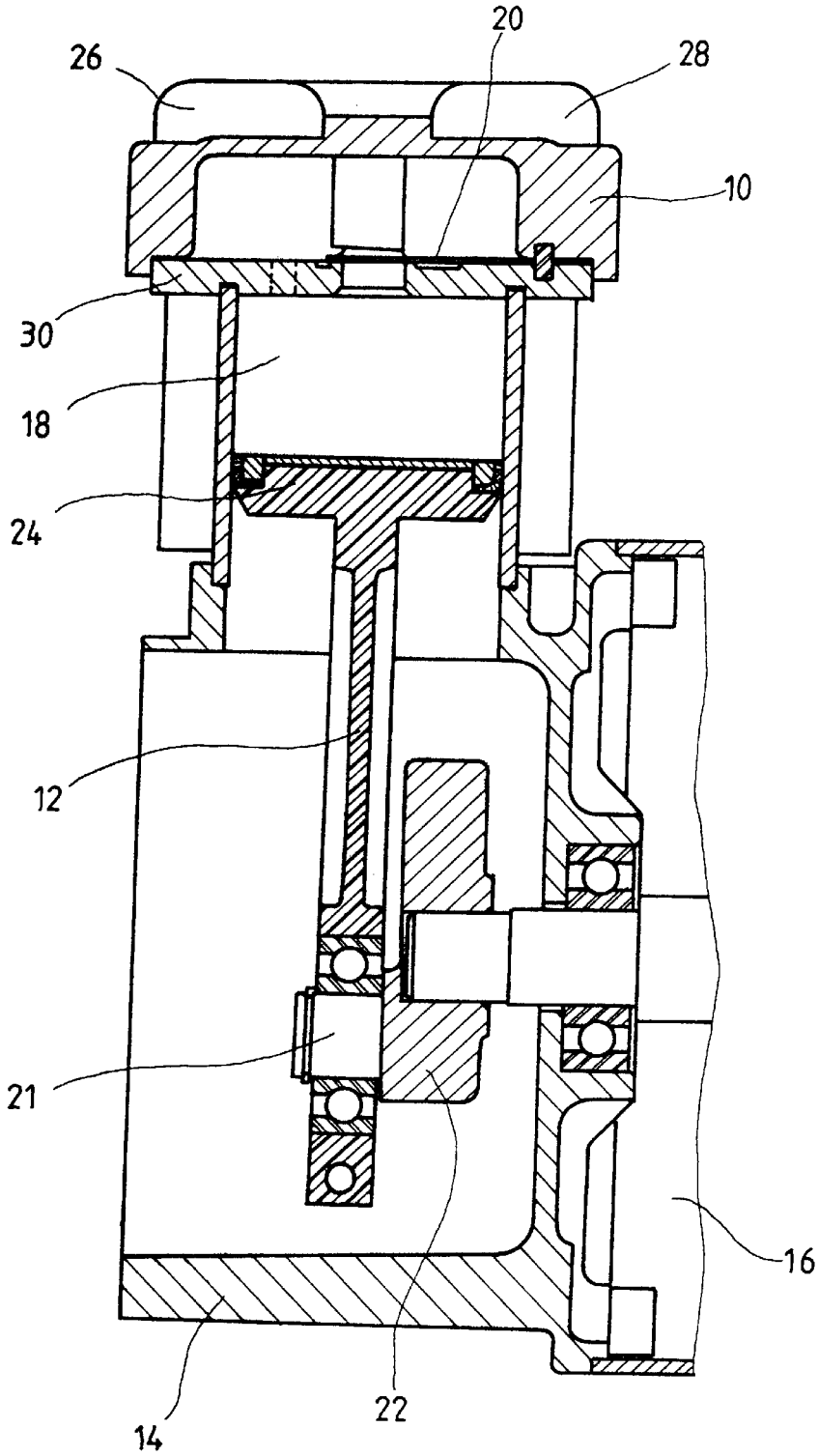
FIG. 1 (PRIOR ART)
FIG. 1 is a sectioned side view of a conventional air compressor.
Figure 2:
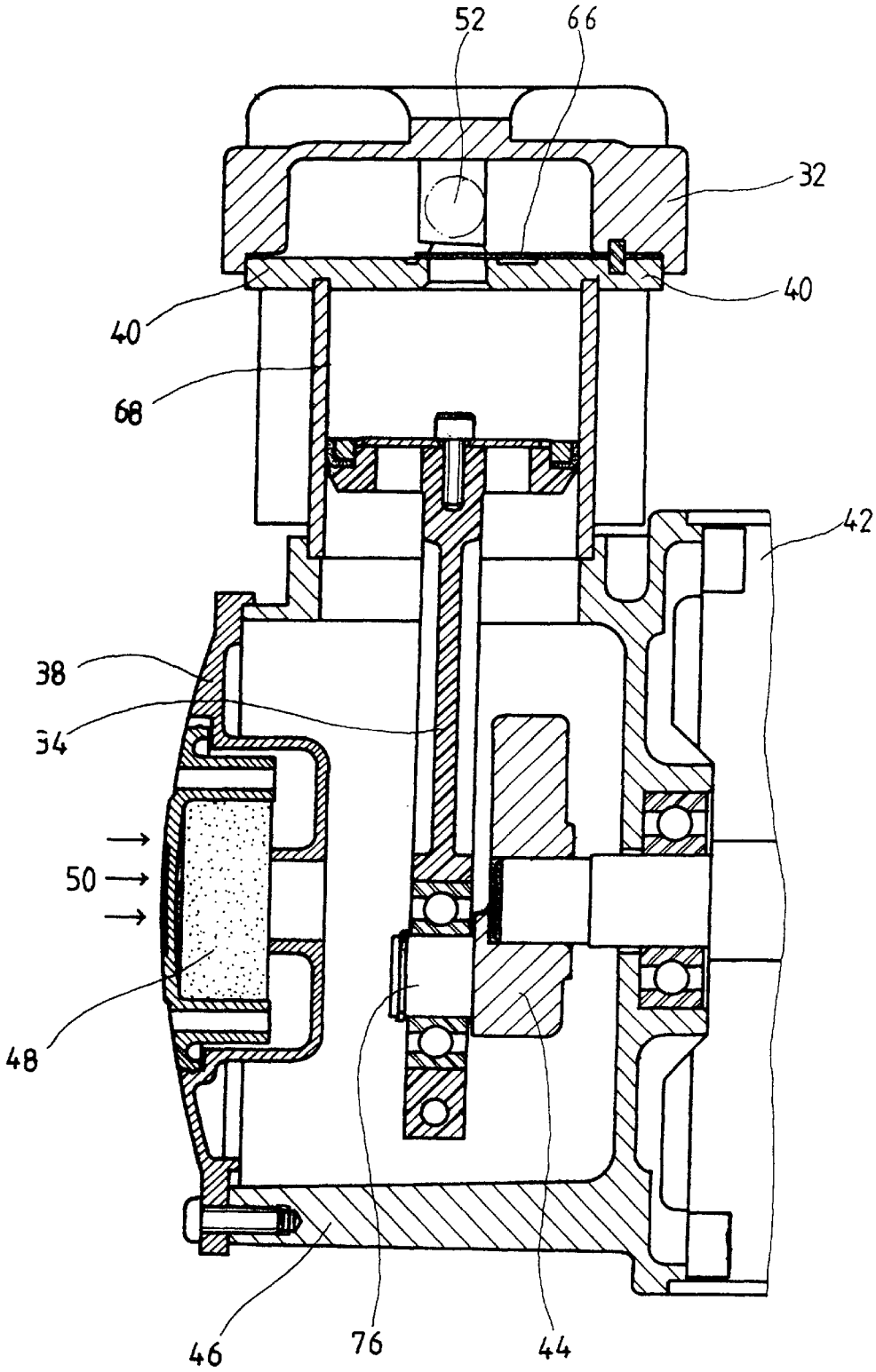
FIG. 2 is a sectioned side view of an oil-free air compressor of the present invention.

Please refer to FIG. 2 that is a sectioned side view of an oil-free air compressor according to the present invention. As shown, the oil-free air compressor is different from the conventional air compressor of FIG. 1 in its air inlet 50 and air outlet 52. The oil-free air compressor of the present invention is provided at a lateral end of a crankcase 46 thereof with a side cover 38, a central portion of which having a filter 48 mounted thereto for preventing impurities in external air from entering into a cylinder 68 of the air compressor. A cylinder head 32 of the air compressor is provided with only an air outlet 52 for discharging compressed air to an air storage tank (not shown).

Figure 3:
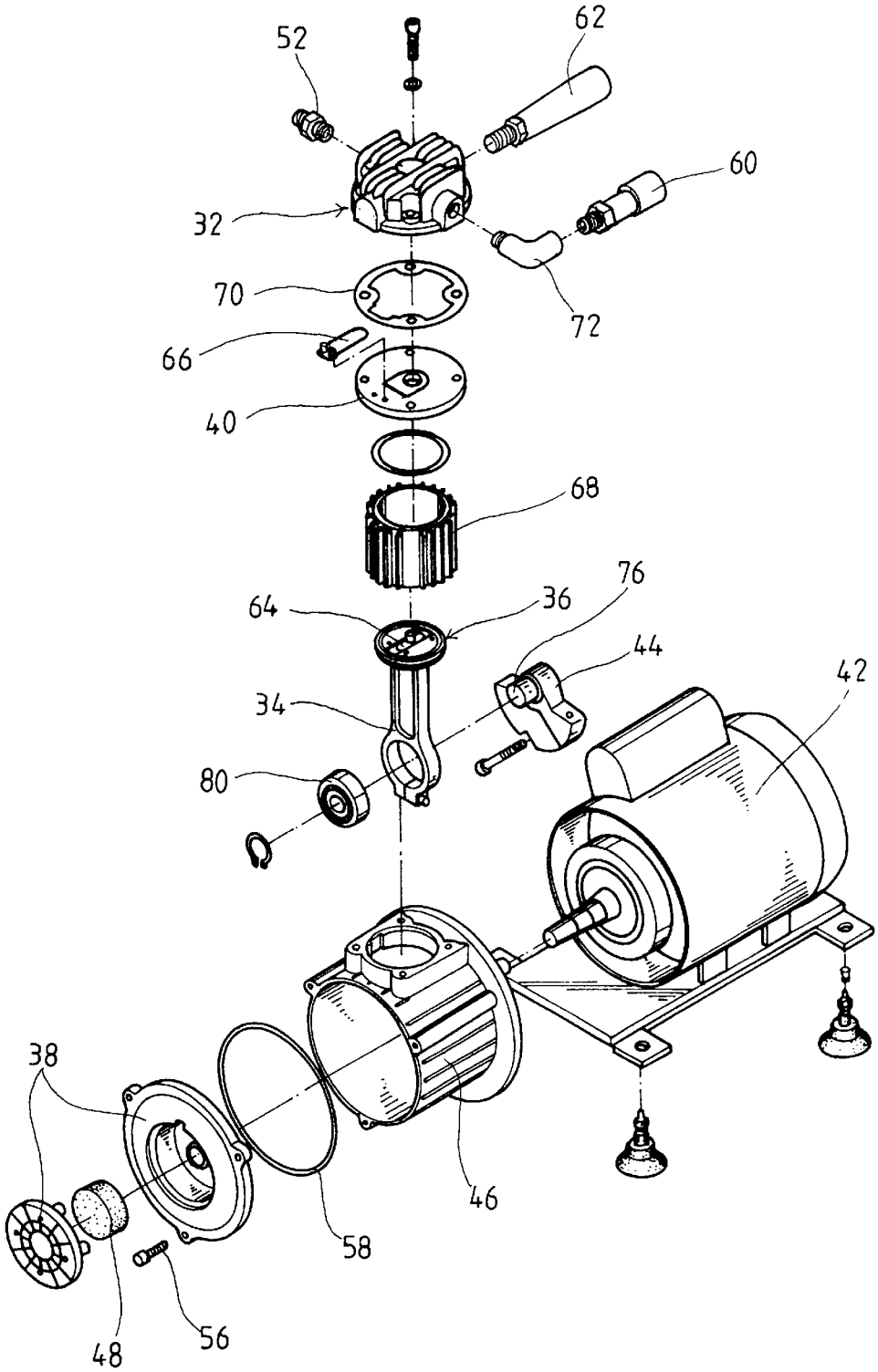
FIG. 3 is an exploded perspective view of an oil-free air compressor according to a first embodiment of the present invention.
Figure 6:
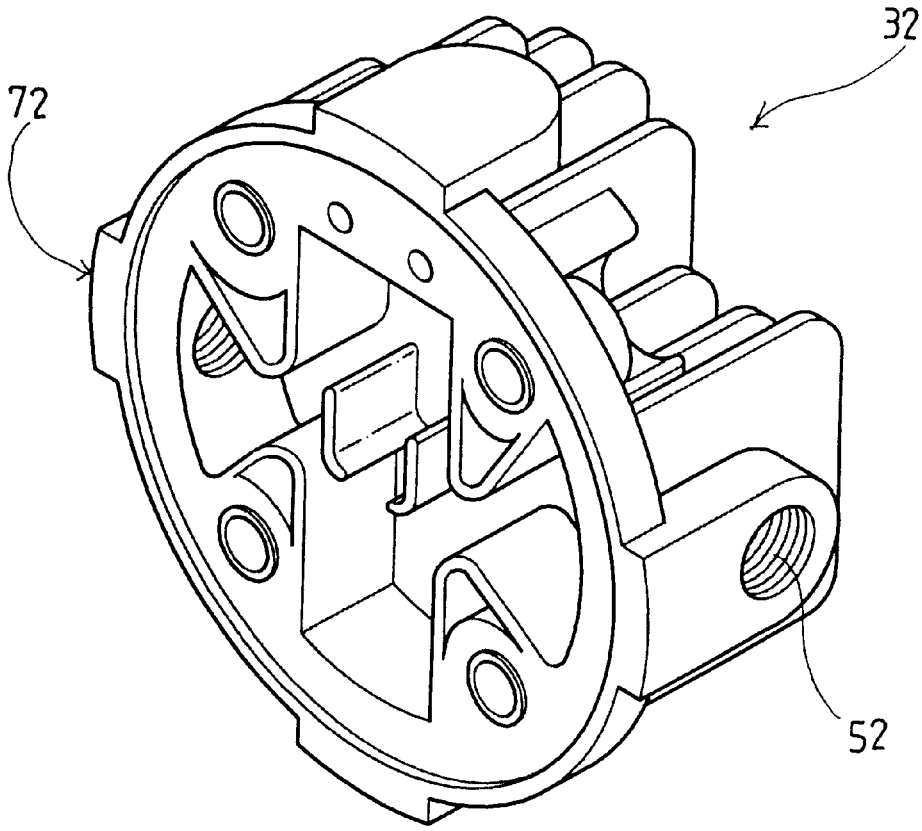
FIG. 6 is an enlarged perspective view of a cylinder head for the present invention.

Please refer to FIGS. 3 and 6 at the same time. FIG. 3 is an exploded perspective view of an oil-free air compressor according to a first embodiment of the present invention, and FIG. 6 is an enlarged perspective view of a cylinder head 32 for the present invention. The oil-free air compressor of FIG. 3 generally includes a motor 42, an idle wheel 44 driven by the motor 42 to rotate, a piston rod 34 connected at a lower end to a round shaft 76 on the idle wheel 44 and driven by the motor 42 to move via the idle wheel 44, a crankcase 46 having an end fixedly screwed to a lateral side of the motor 42 and being formed of a top opening 74, a side cover 38 screwed to another open end of the crankcase 46 with screws 56 and a sealing packing 58, a filter 48 removably mounted to a central portion of the side cover 38, and a cylinder assembly communicably located above the top opening 74 of the crankcase 46. The cylinder assembly includes two check valves 64, 66, a cylinder head 32, an O-ring 70, a top cover 40, a cylinder 68, and the above-mentioned piston rod 34.

The cylinder head 32 is provided with only an air outlet 52 for discharging compressed air to an air storage tank (not shown). The cylinder head 32 shown in FIGS. 3 and 6 has two holes, one of which is the air outlet 52 while the other one has a union 72 mounted thereto for connecting an air pressure regulator valve 60 to properly control the pressure of air discharged to the air storage tank. A handle 62 may be connected to the cylinder head 32 to facilitate carrying of the air compressor conveniently. The piston rod 34 includes a piston head 36 and is adapted to move in the cylinder 68 in reciprocating motion. The check valves 64, 66 are mounted on the piston head 36 and the top cover 40, respectively, to prevent air from flowing backward. A lower end of the piston rod 34 is connected to the idle wheel 44 by mounting around the round shaft 76 via a bearing 80, so that the piston rod 34 is driven to move by a force transferred to it from the motor 42 via the idle wheel 44.

When the oil-free air compressor of the present invention operates, the motor 42 causes the round shaft 76 to move in circular motion and thereby drives the piston rod 34 for the piston head 36 to move in the cylinder 68 in reciprocating motion. External air enters into the crankcase 46 via the side cover 38 and passes through the check valve 64 on the piston head 36 to enter into the cylinder 68, at where the air is compressed with the piston head 36. The compressed air then passes through the check valve 66 and is discharged via the air outlet 52 to the air storage tank. In brief, the oil-free air compressor of the present invention provides compressed air through a reciprocating compressional motion.

Figure 4:
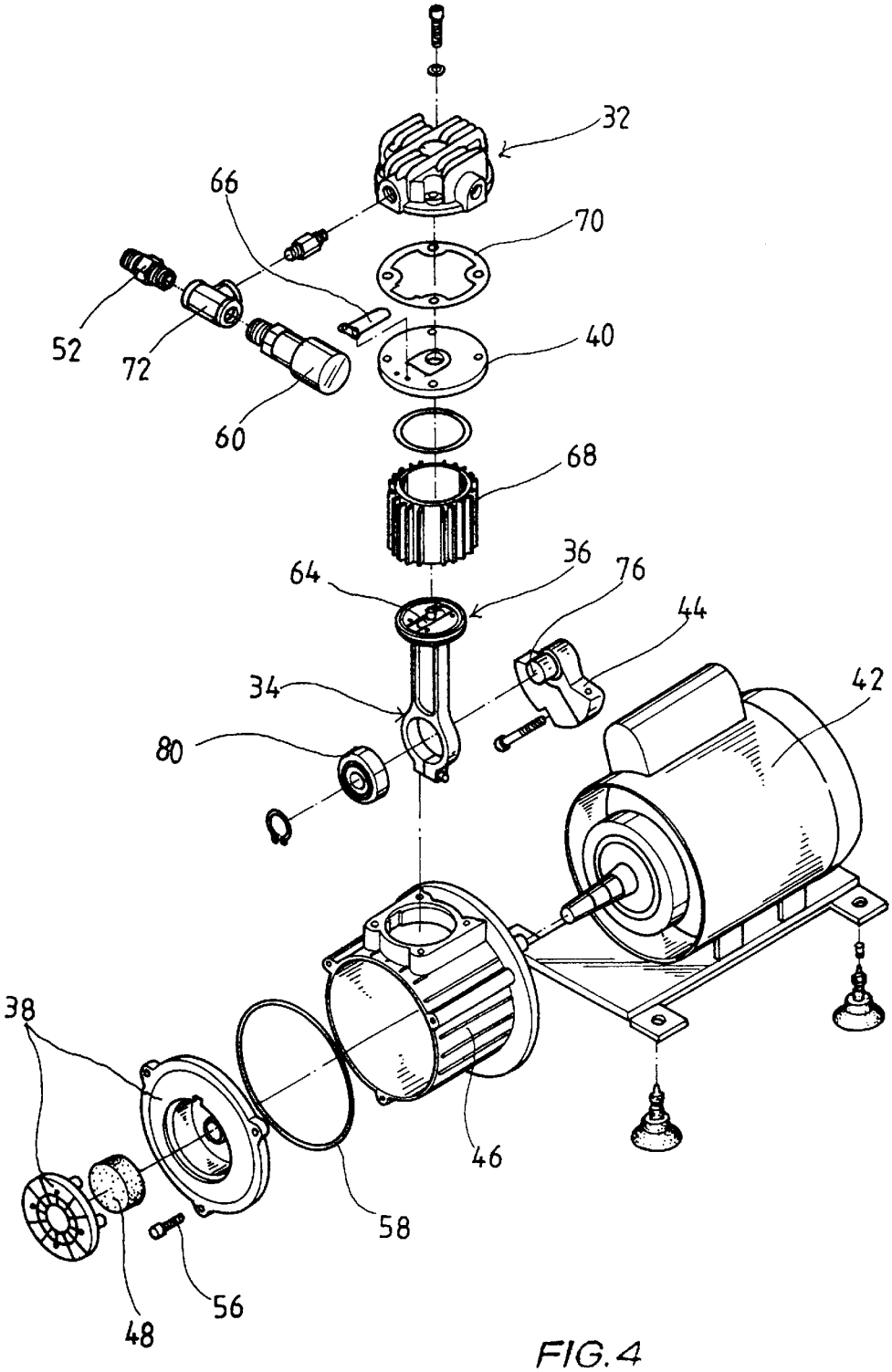
FIG. 4 is an exploded perspective view of an oil-free air compressor according to a second embodiment of the present invention.

FIG. 4 is an exploded perspective view of an oil-free air compressor according to another embodiment of the present invention. This embodiment is generally similar to the first one except that it has a cylinder head 32 having only one hole, to which a three-way union 72 is mounted to connect an air pressure regulator valve 60 and an air outlet 52 thereto.

Figure 5:
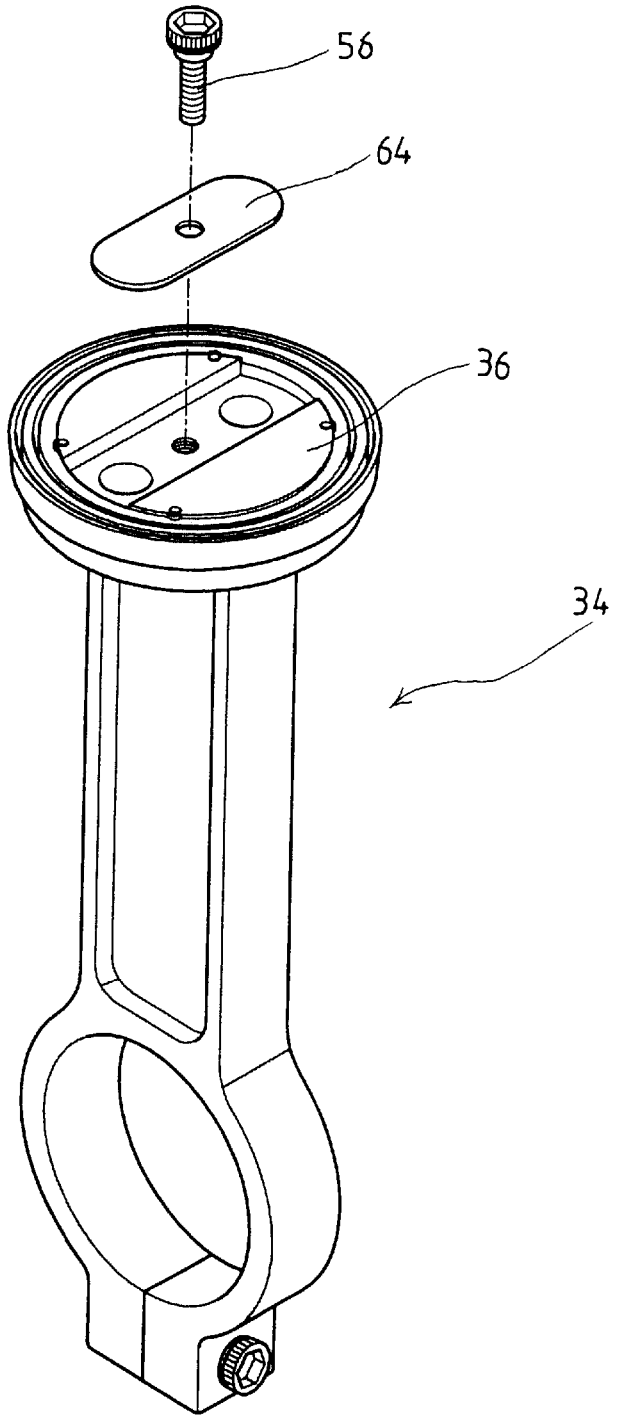
FIG. 5 is an enlarged perspective view of a piston rod for the present invention.

FIG. 5 is an enlarged perspective view of the piston rod 34. As can be clearly seen from FIG. 5, the check valve 64 provided on the piston head 36 is screwed thereto with a screw 56. And, FIG. 6 is an enlarged perspective view of the cylinder head 32. As can be clearly seen from FIG. 6, the cylinder head 32 is provided with two holes, one of which is the air outlet 52 and the other one is adapted to connect the union 72.

The oil-free air compressor of the present invention employs the reciprocating motions of the piston rod 34 and the piston head 36 in the cylinder 68 to guide external air into the cylinder 68 via the side cover 38 of the crankcase 46 and the check valve 64 on the piston head 36. The air guided into the cylinder 68 is then compressed with the piston rod 34 and the piston head 36 before being discharged via the air outlet 52 on the cylinder head 32 to the air storage tank and be stored therein. With these arrangements, air guided into the cylinder 68 is cold air that lowers the temperature of the piston head in the reciprocating motion and therefore enables enhanced compression efficiency and extended usable life of the cylinder assembly. Moreover, the filter 48 mounted on the side cover 38 of the crankcase 46 effectively screens off impurities in the external air to protect the air compressor against damages possibly caused by such impurities.

What is claimed is:

1. An oil-free air compressor, comprising a motor, a crankcase, a cylinder assembly, and an air outlet; said motor driving a piston rod to move in a cylinder of said cylinder assembly in reciprocating compressional motion, so that external air is guided into said cylinder and compressed with said piston rod and then discharged through said air outlet; said oil-free air compressor being characterized in that said crankcase is provided at a lateral open end with a side cover screwed thereto and a filter removably mounted on said side cover to form an air inlet; that said piston rod has a piston head, on which a first check valve is mounted, so that air guided into said crankcase via said air inlet flows through said first check valve into said cylinder without the possibility of flowing backward; and that said cylinder has a cylinder head being provided with an air outlet and a second check valve is provided above said cylinder, so that air being compressed in said cylinder flows through said second check valve and said air outlet; whereby when said air compressor is in operation, said motor drives said piston rod to move and causes said piston head to reciprocate in said cylinder, so that external air is guided into said crankcase via said side cover to enter into said cylinder via said first check valve on said piston head and being compressed by said piston head before passing through said second check valve and through said air outlet.

2. The oil-free air compressor as claimed in claim 1, wherein said cylinder head is provided with an air pressure regulator valve that may be connected to a piping that is also used to connect said air outlet.

* * * * *